US006830172B2

(12) United States Patent
Rajala

(10) Patent No.: US 6,830,172 B2
(45) Date of Patent: Dec. 14, 2004

(54) APPARATUS AND METHOD FOR FEEDING STRING

(75) Inventor: Gregory J. Rajala, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 0 days.

(21) Appl. No.: 10/200,781

(22) Filed: Jul. 23, 2002

(65) Prior Publication Data

US 2003/0080170 A1 May 1, 2003

Related U.S. Application Data

(63) Continuation-in-part of application No. 10/055,573, filed on Oct. 26, 2001, now Pat. No. 6,669,130.

(51) Int. Cl.[7] ..... B65H 23/18

(52) U.S. Cl. ..... 226/4; 226/188; 226/97.4

(58) Field of Search ..... 226/4, 8, 122, 226/97.4; 242/419.3, 366, 364.11, 366.4, 365.7, 564.3

(56) References Cited

U.S. PATENT DOCUMENTS

| | | | | |
|---|---|---|---|---|
| 2,002,995 A | * | 5/1935 | Hartmann et al. | 68/19 |
| 2,302,790 A | | 11/1942 | Modigliani | |
| 2,350,182 A | | 5/1944 | Neff | |
| 2,424,490 A | | 7/1947 | Henry | |
| 2,678,173 A | | 5/1954 | Phelps | |
| 2,771,180 A | | 11/1956 | Barker | |
| 2,912,100 A | * | 11/1959 | Logan | 226/122 |
| 3,106,354 A | | 10/1963 | Kitselman | |
| 3,747,863 A | | 7/1973 | Klementz et al. | |
| 3,834,600 A | | 9/1974 | Benchemoul | |
| 3,917,141 A | | 11/1975 | Sartori | |
| 3,988,101 A | | 10/1976 | Aspin | |
| 4,172,544 A | | 10/1979 | Pennings et al. | |
| 4,678,132 A | | 7/1987 | Fowler et al. | |
| 4,817,880 A | | 4/1989 | Lenk et al. | |
| 4,890,800 A | | 1/1990 | Lenk et al. | |
| 5,103,876 A | | 4/1992 | Benz et al. | |
| 5,632,308 A | | 5/1997 | Bucher et al. | |
| 6,022,443 A | | 2/2000 | Rajala et al. | |
| 6,165,306 A | | 12/2000 | Rajala | |

FOREIGN PATENT DOCUMENTS

GB 2 092 188 A 8/1982

* cited by examiner

*Primary Examiner*—William A. Rivera

(57) ABSTRACT

A method of and apparatus for feeding string from a supply involves entraining the string around at least one feed roll and driving the feed roll continuously in cycles in a direction for feeding the string forward. Each of the cycles involves varying the speed of the roll for feeding a predetermined length of string forward per cycle. The string is subjected to a force in the reverse direction upstream from the feed roll and to a force in the forward direction downstream from the feed roll.

13 Claims, 8 Drawing Sheets

APPARATUS AND METHOD FOR FEEDING STRING

CROSS-REFERENCE TO RELATED APPLICATION

This application is a continuation-in-part of the coassigned U.S. patent application of Gregory J. Rajala, Ser. No. 10/055,573, filed Oct. 26, 2001 now U.S. Pat. No. 6,669, 130, entitled Feeding String which is hereby incorporated by reference.

BACKGROUND OF THE INVENTION

This invention relates generally to feeding string, more particularly to a method of and apparatus for precision feeding of string forward to apparatus in which string is utilized.

The invention is especially concerned with feeding string forward from a supply to apparatus in which predetermined lengths of string are utilized, such as a high speed stringer for attaching string to items.

The term "string" as used herein encompasses what is ordinarily regarded as "string" as well as flexible string-like strands.

BRIEF SUMMARY OF THE INVENTION

In general, the method of the invention feeds string forward from a supply. The method comprises entraining the string coming from the supply around at least one feed roll, driving the roll in the direction for feeding the string forward, subjecting the string to a force in the reverse direction upstream from the roll, and subjecting the string to a forwarding force downstream from the roll.

Apparatus of the invention generally involves a feed roll, a motor for driving the feed roll in the direction for feeding the string forward, a retarder for subjecting the string to force in the reverse direction upstream from the roll for retarding its forward feed, and an accelerator for subjecting the string to a forwarding force downstream from the roll for exerting a pull on the string to tension the portion of the string between the retarder and the accelerator. A feature of the invention is the driving of the feed roll continuously in cycles each involving varying speed of the roll for feeding predetermined lengths of string forward per cycles. A further feature is the carrying out of the variable speed drive by different means.

Other features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
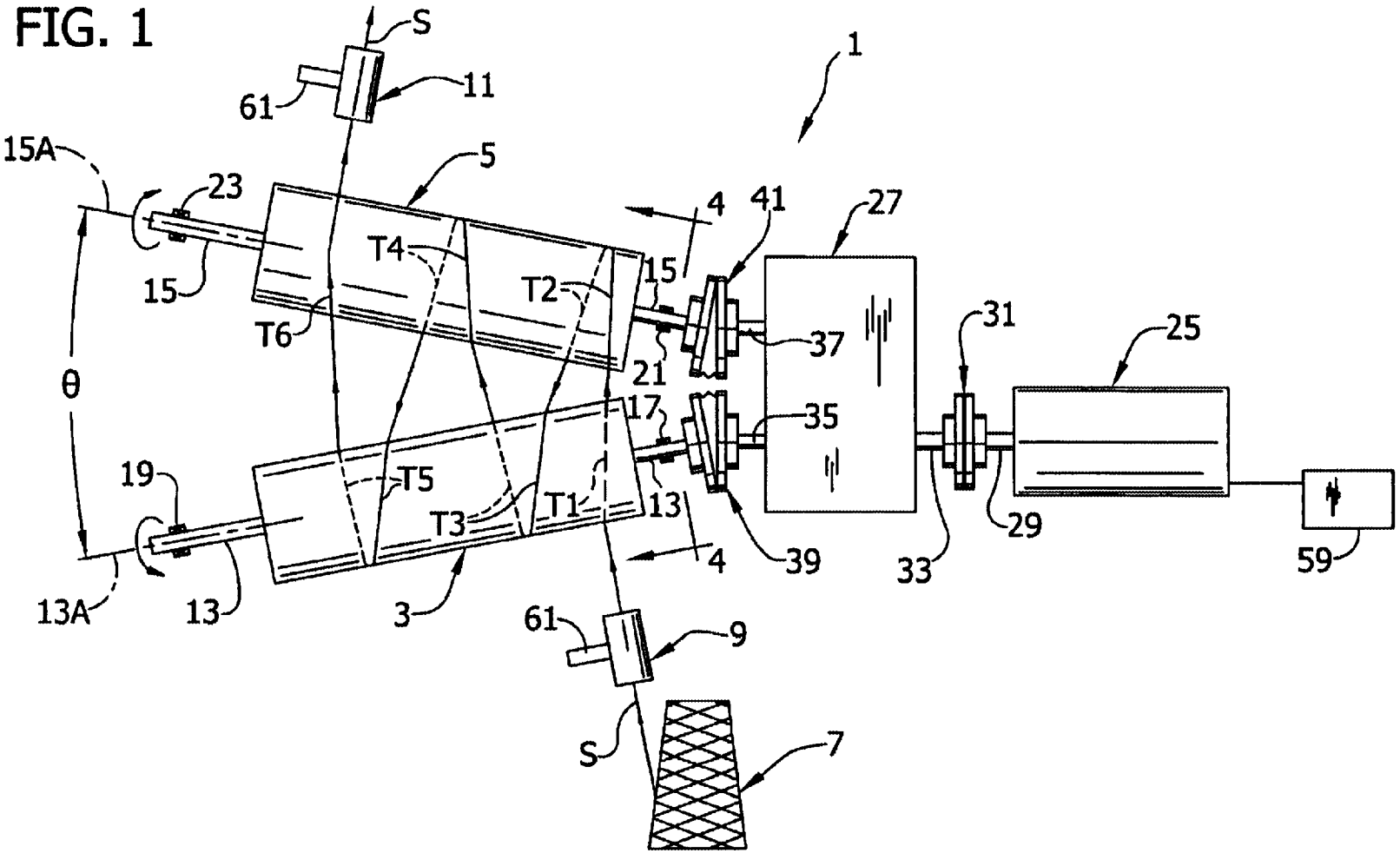
FIG. 1 is a semi-diagrammatic view of a first version of apparatus of this invention, said apparatus carrying out the generic method of the invention and a first species of the method.

Referring first to FIG. 1, an apparatus of this invention for carrying out the method of this invention, designated 1 in its entirety, is shown to comprise at least one feed roll and specifically two rolls 3 and 5 for feeding forward string S pulled from a supply 7. The supply 7 is shown as a cop of string, i.e., a wound supply on a conical bobbin. The string S coming from the supply (i.e., being unwound from the cop) is entrained around the rolls in a manner to be described, first around the first roll 3 and then around the second roll 5. Each roll is adapted to be positively driven in the direction for the forward feed of the string (as entrained around the rolls).

At 9 is generally indicated what may be broadly termed a retarder, operable as a drag brake or decelerator, for subjecting the string coming from the supply to force in a reverse direction with respect to the forward feed direction for retarding its forward feed. The retarder is interposed between the supply 7 and the first roll 3, i.e., upstream from the first roll. At 11 is generally indicated what may be broadly termed an accelerator for subjecting the string coming from the second roll 5 (i.e., downstream from the second roll) to a forwarding force. Being retarded (held back, in effect braked) upstream from the rolls and accelerated (pulled forward) downstream from the rolls, the reach of string entrained around the rolls is tensioned and travels around the rolls in good contact therewith.

Each of the rolls 3 and 5 is preferably a godet roll (i.e., a plastic-coated steel roll) of elongate cylindrical form. Roll 3 is on an axial shaft 13 and roll 5 is on an axial shaft 15. Shaft 13 is journalled in inboard and outboard bearings 17 and 19 and shaft 15 is journalled in inboard and outboard bearings 21 and 23. The axis 13A of roll 3 and the axis 15A of roll 5 (and hence the rolls) are oriented at an acute angle 6 to one another, divergent from the ends of the rolls at the inboard bearings 17, 21. Angle 6 may range from about two degrees to about thirty degrees, and in one embodiment angle 6 is about twelve degrees. The rolls are mounted in close proximity to one another.

Indicated at 25 in FIG. 1 is an electric motor, specifically a servomotor, for driving the rolls 3 and 5 via a gearbox 27. The output shaft 29 of the motor is coupled as indicated at 31 to the input shaft 33 of the gearbox. The latter is a reversing speed-reducing gearbox containing gearing for driving two output shafts 35 and 37 in opposite directions. The output shaft 35 of the gearbox is coupled as indicated at 39 to the roll shaft 13 and the output shaft 37 of the gearbox is coupled as indicated at 41 to the roll shaft 15.

Figure 2:
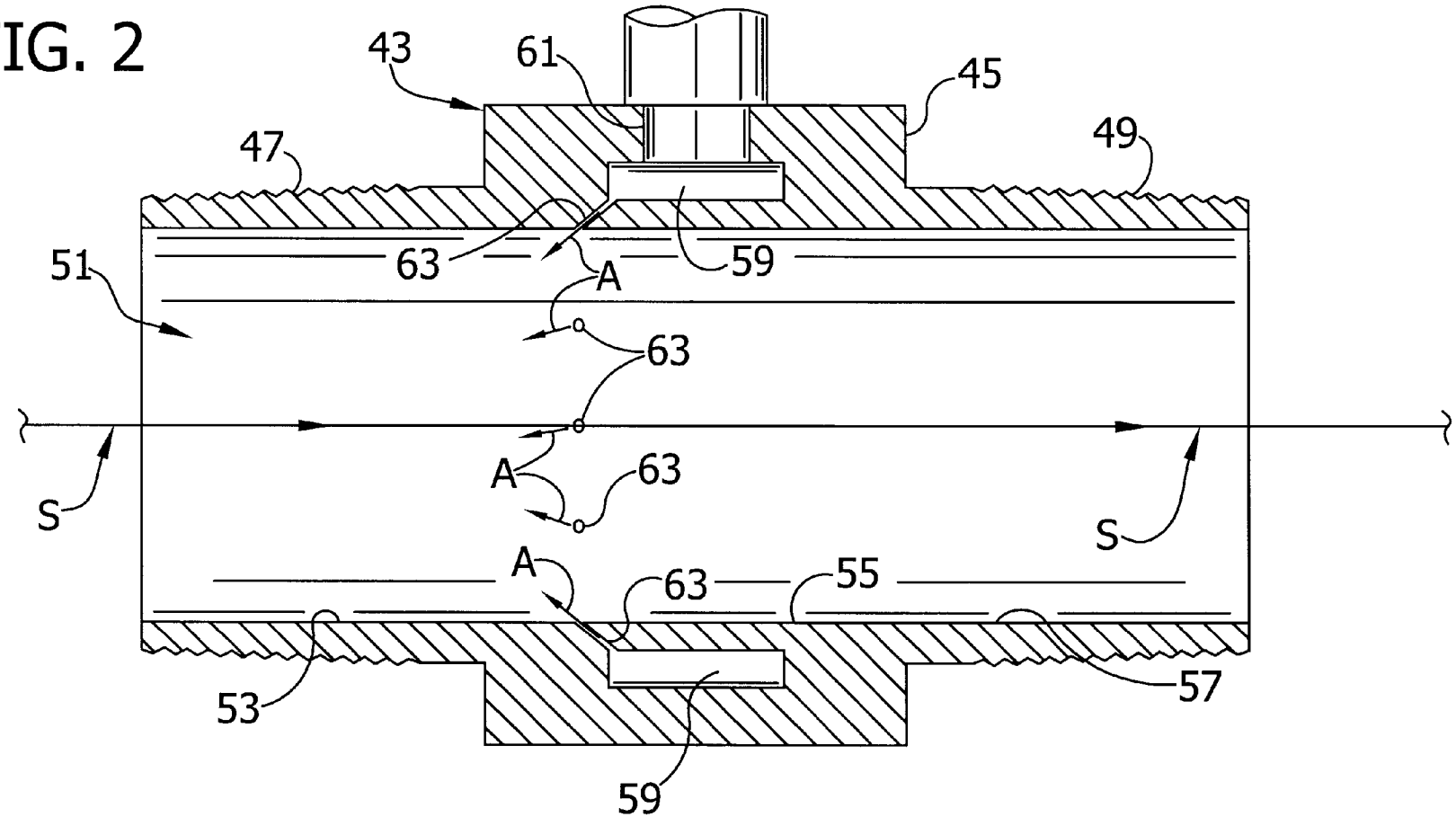
FIGS. 2 and 3 are enlarged longitudinal cross-sections of what are termed a "retarder" and an "accelerator" of the apparatus shown in FIG. 1.

The retarder 9 comprises an instrumentality which may be termed a venturi. The retarder 9 subjects the string to force in the reverse direction with respect to the forward feed of the string by gas flow, more particularly by a flow of air. The venturi which has been used is a commercially available item, in particular an EXAIR® unit sold by Exair Corporation of Cincinnati, Ohio. As shown in FIG. 2, this unit comprises a tubular body designated 43 in its entirety open at both ends having a central section 45 and end sections 47 and 49 (on opposite sides of the central section). Further, the unit has a passage 51 through the body 43 having an upstream section 53, an intermediate section 55 and a downstream section 57. The central section 45 of the body 43 has an annular plenum chamber 59. An air inlet 61 supplies air from a source under pressure (not shown) to the plenum chamber 59. Ports or nozzles 63 extend at an angle from the plenum chamber 59 to the central section 55 of the passage 51 for injecting air under pressure into section 55 in the direction of section 53 of the passage 51. Air blows out of the ports and through section 53 (note air direction arrows A in FIG. 2). String S, coming from the supply 7 (e.g., cop), travels through the passage 51 generally out of contact with the body 43 of the venturi 9, and is retarded in its travel by action of the air blowing on the string.

Figure 3:
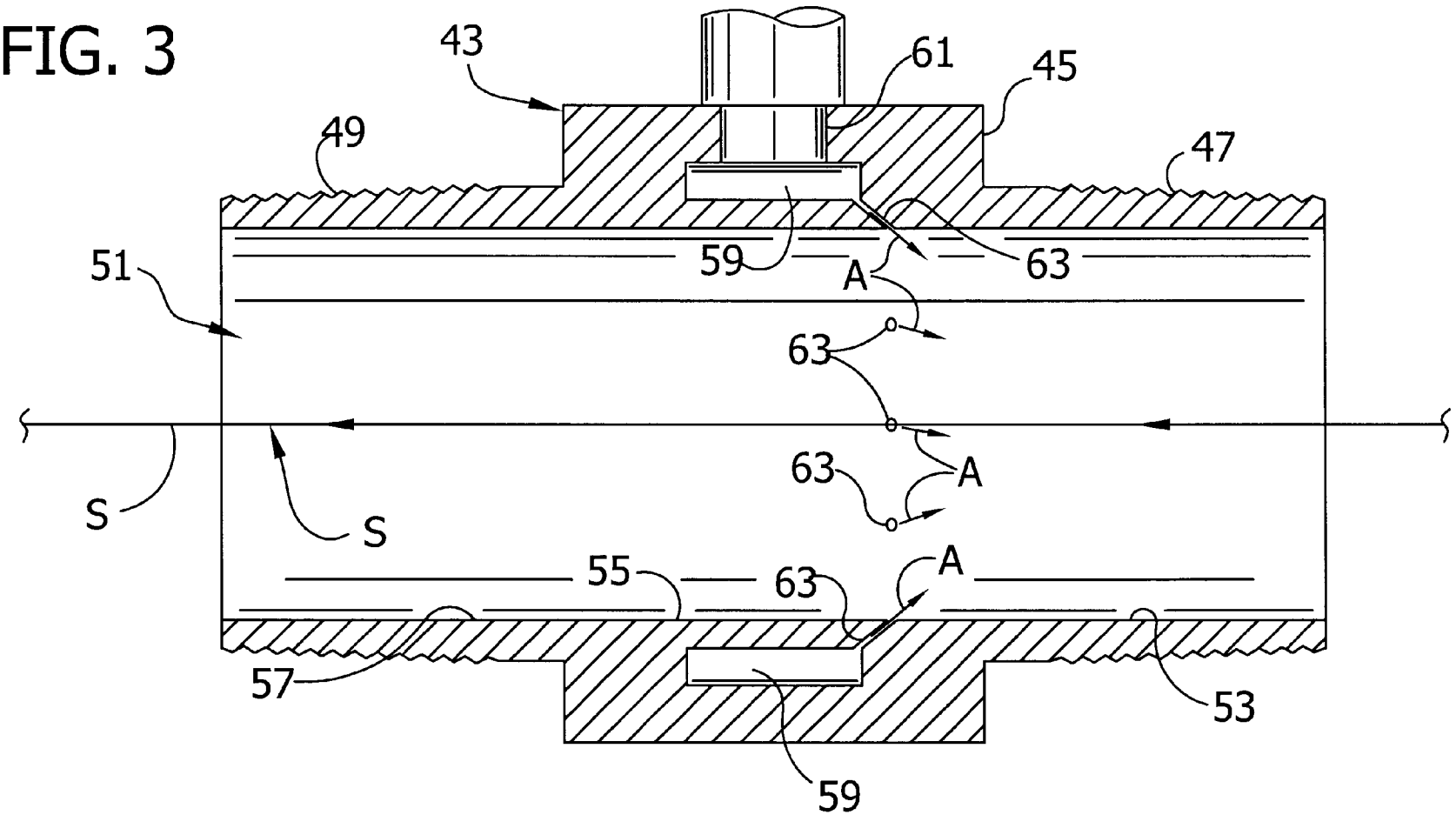

The accelerator 11 comprises a similar to the retarder 9 but oppositely oriented as shown in FIG. 3 from the retarder 9 as it appears in FIG. 2. String 5, coming from the supply 7, travels first through section 53 then through sections 55 and 57 of the passage 51 of retarder 9, but string 5, coming from the roll 5, travels first through section 57 then through sections 55 and 53 of the passage 51 of accelerator 11. String S traveling through the accelerator 11 travels out of contact with the body 43 of accelerator 11. Air blows out of the ports 63 of accelerator 11 and through section 53 of passage 51 of accelerator 11, thus subjecting the string to an accelerating force.

Figure 4:
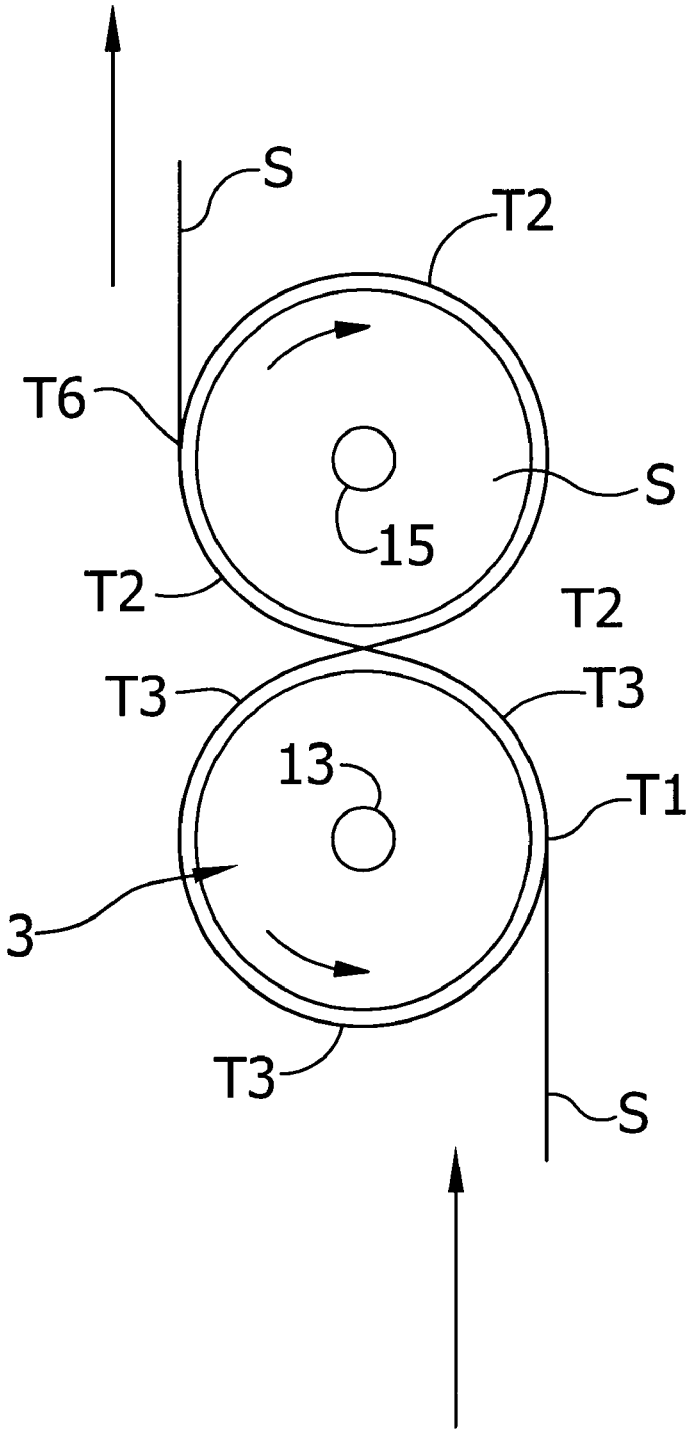
FIG. 4 is a cross-section generally on line 4—4 of FIG. 1 on a larger scale than FIG. 1.

The string S, coming from the supply 7 and threaded through the retarder 9 is entrained around the first and second godet rolls 3 and 5 in a figure-s path. As shown in FIG. 4, the entrainment involves the string first passing under and for about a one-quarter turn T1 around roll 3, then over and around roll 5 in almost a full turn T2, then back and over and around roll 3 in almost a full turn T3, then forward over and around roll 5 in almost a full turn T4, then back and over and around roll 3 in almost a full turn T5, and then forward and around roll 5 in about a one-quarter turn TG, then being threaded through the downstream accelerator 11. The turns are spaced axially on the rolls. As will be appreciated by those skilled in the art, the spacing between turns is dependent on the angle 2 between the axes 13A, 15A of the rolls 13, 15. The spacing increases with the angle 2.

During operation of the apparatus 1 of the present invention, predetermined lengths of string S are fed forward, issuing from the downstream accelerator 11 and fed to apparatus (not of this invention and not shown) in which the lengths of string are utilized. Rolls 3 and 5 are continuously driven by servomotor 25 via the gearbox 27 each in the direction for feeding the string forward in recurring cycles. During each cycle, the rolls 3 and 5 are first driven at a relatively low rate of speed (e.g., at a speed for feeding the string forward at 600–800 feet per minute), then sped up and driven at a higher rate of speed (e.g., at a speed for feeding the string forward at about 1200 feet per minute), then slowed down and driven at the aforementioned relatively low rate of speed. This slow-fast-slow cycle is obtained by controlling the servomotor 25 by a controller 59.

The servomotor and controller which have been used are commercial item, in particular an ALLEN-BRADLEY®Model A320P-HK22AA AC Servomotor and an ALLEN-BRADLEY®Model 1394 Servo Drive Control System, each of which are sold by Allen-Bradley Company Inc. of Milwaukee, Wis. The slow-fast-slow cycle typically involves operation at the slow speed for the first 14 of the cycle, ramping up the speed to the high speed in the next 14 of the cycle, running at the high speed for the third 14 of the cycle, and slowing down to the low speed in the last 14 of the cycle. The length of string fed forward on each cycle is determined by the number of revolutions of rolls 3 and 5 in the cycle, and the number of revolutions of the rolls during each cycle is a matter of the setting of the controller to operate the servomotor for the requisite number of revolutions of the rolls in each cycle interval. A typical setting where the rolls 3 and 5 are each four inch diameter rolls, making their circumference 12.57 inches (4B), is for rotation of the rolls roughly 1.23 revolutions in each cycle for feeding 15.5 inches of string on each cycle.

The retardation of the string by the upstream retarder 9 and the acceleration of the string by the downstream accelerator 11 subjects the string passing around the rolls 3 and 5 to tension which, though relatively low, is sufficient to maintain the string in relatively intimate frictional contact with the rolls, thus tending to insure accurate feeding of the string. This is achieved even when feeding the string at the non-constant rate as described above to feed apparatus utilizing the string at a non-constant rate. The angling and spacing of the rolls tends to prevent tangling of the turns on the surface of the rolls.

Figure 5:
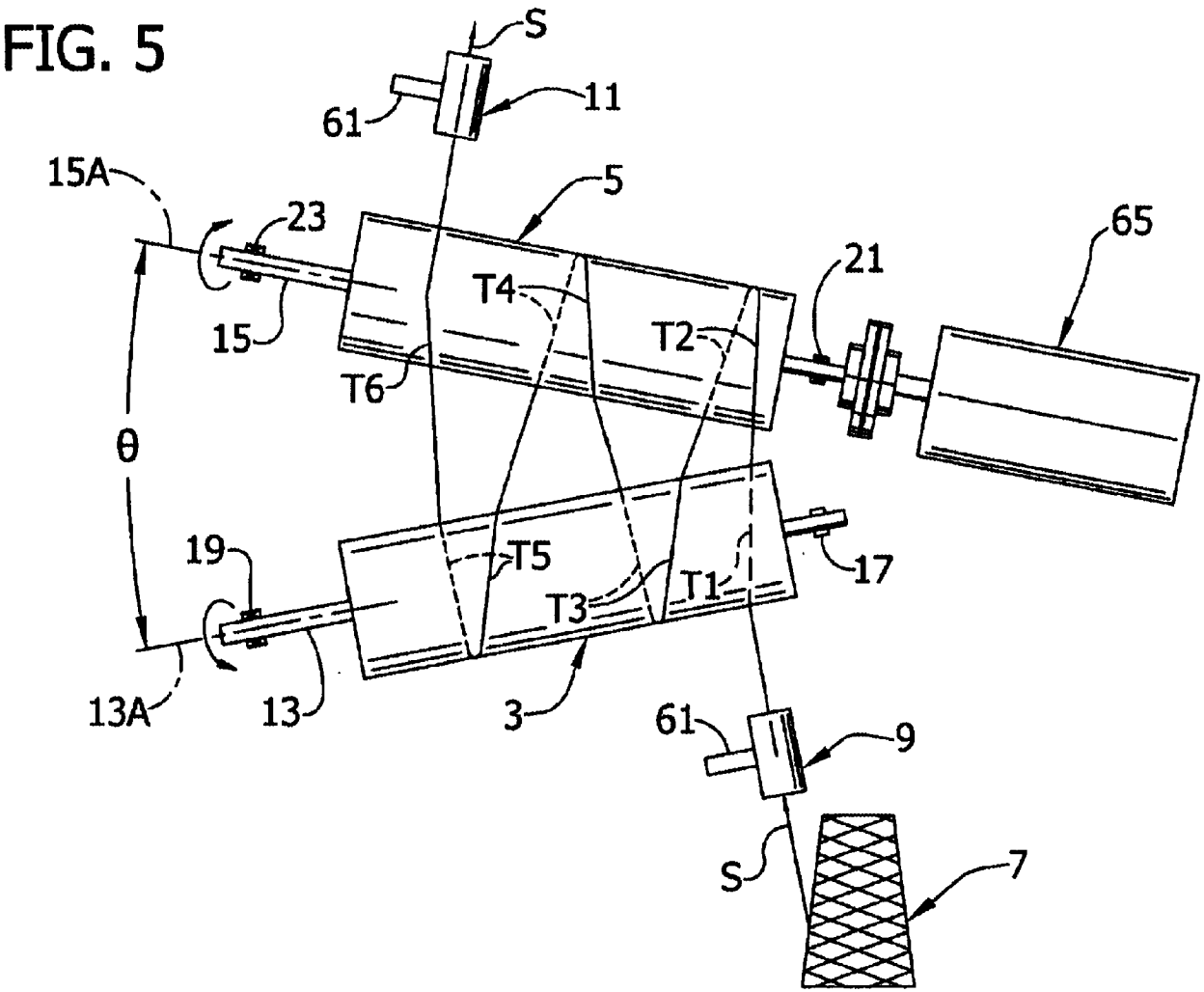
FIG. 5 is a semi-diagrammatic view of a second version of the apparatus, which also carries out the generic method and a second species of the method.

While the above-described method and apparatus continuously feed the string S forward in slow-fast-slow cycles (i.e., at a non-constant rate), the method and apparatus may be such as to feed the string forward continuously at a constant (invariant) rate. Such method and apparatus is illustrated in FIG. 5, being the same as illustrated in FIGS. 1–4 except that only the roll 5 is positively driven by an electric motor/speed reducer unit 65. Roll 3 idles under the torque imparted thereto by the string.

Figure 6:
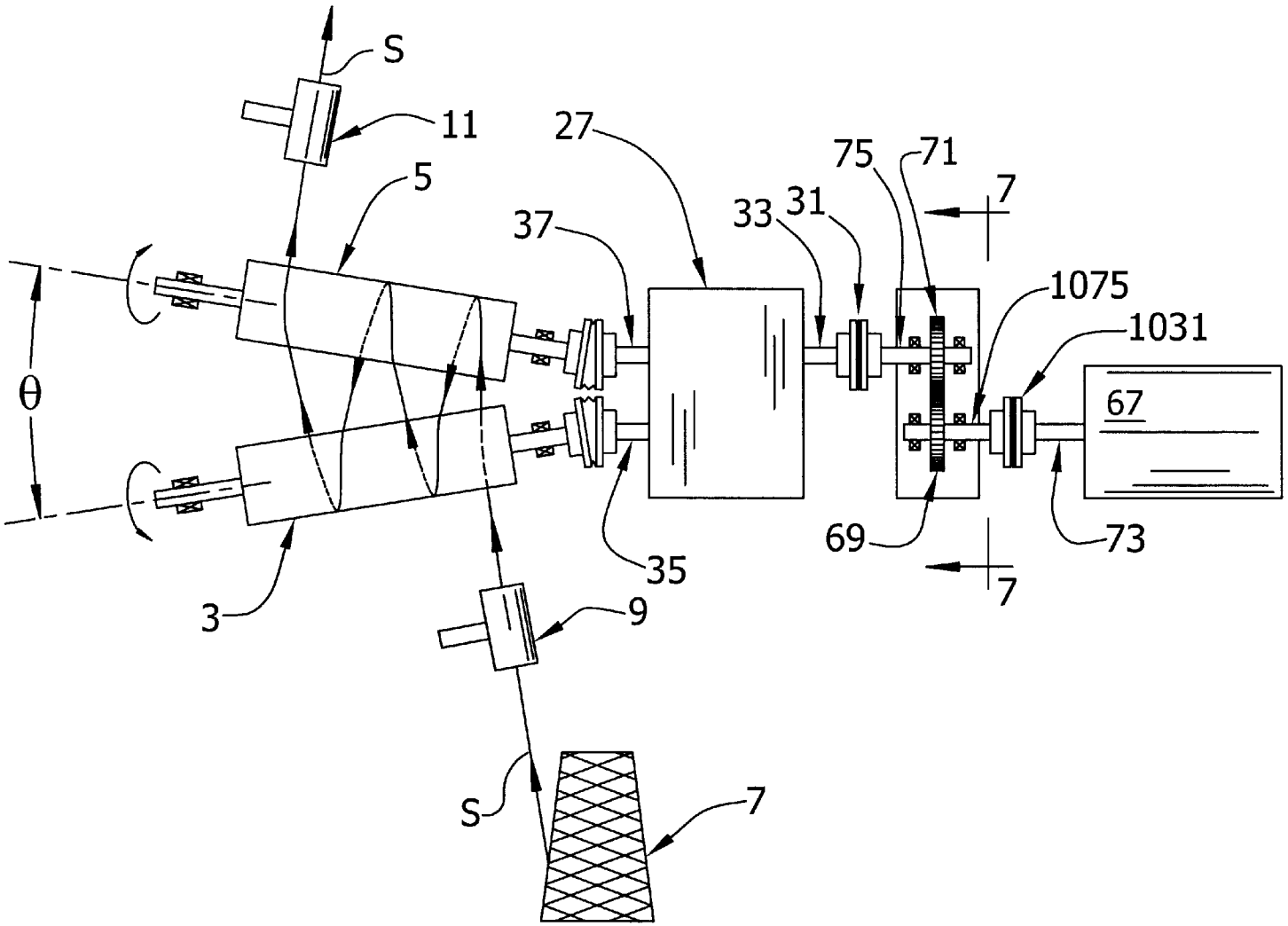
FIG. 6 is a view similar to FIGS. 1 and 5 of a third version of the apparatus.
Figure 7:
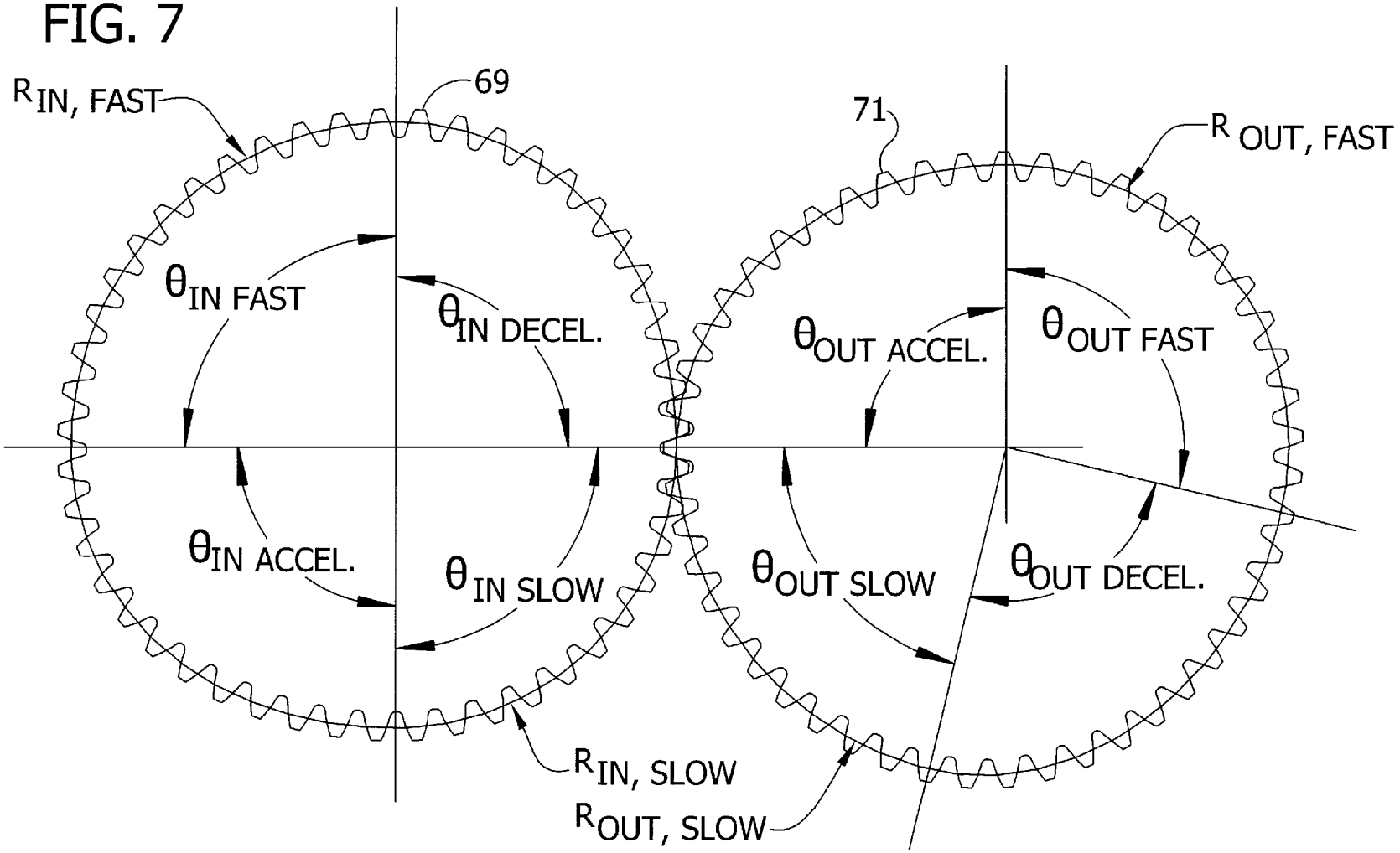
FIG. 7 is a view generally in section on line 7—7 of FIG. 6 on a larger scale than FIG. 6.

FIGS. 6 and 7 illustrate a third version of the apparatus which essentially carries out the same method as the first version shown in FIG. 1 and described above, using the same slow-fast-slow cycle, but achieving this by utilizing a non-circular gear drive instead of the servomotor and controller system of the first version. Thus, the third version as shown in FIGS. 6 and 7 is substantially identical to the first version as shown in FIG. 1 except that the input to the coupling 31 (the input in FIG. 1 comprising the servomotor 25, the controller 59 therefor, and the output shaft 29 of the servomotor), instead comprises a motor 67 operable at a constant speed driving each of the feed rolls 3 and 5 (the godet rolls) via non-circular gears 69 and 71 in the same cycles as aforesaid involving driving the rolls at the relatively low speed for the first one-quarter of the cycle, accelerating to the relatively fast speed in the second one-quarter of the cycle, driving at the relatively fast speed for the third one-quarter of the cycle, and decelerating to the relatively low speed in the last one quarter of the cycle.

Figure 8:
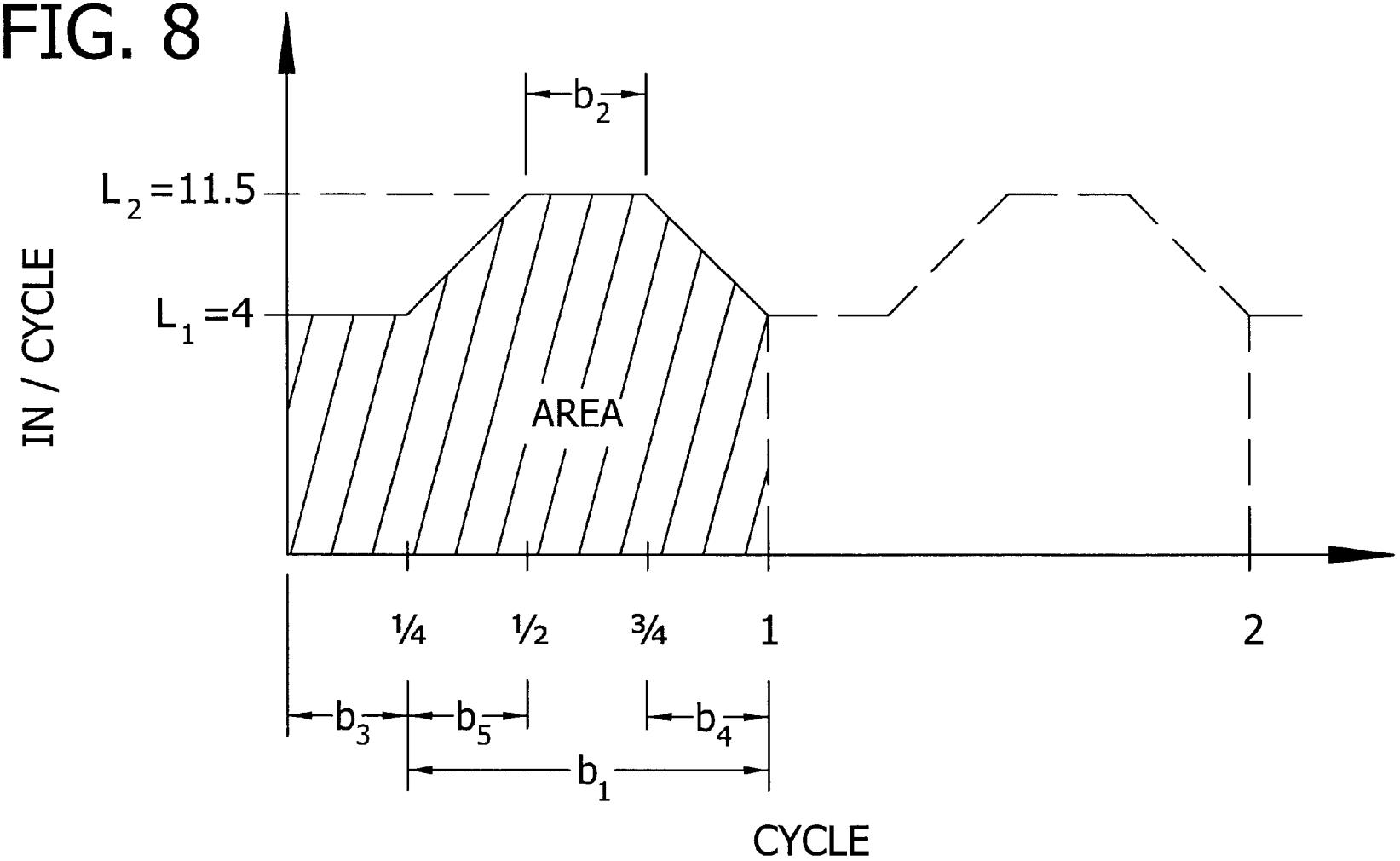
FIG. 8 is a graph showing a typical varying speed curve of the third version of the apparatus (and also the first version).

This slow-fast-slow cycle is depicted graphically in FIG. 8 by the roll speed profile or curve in which the roll speed of the rolls 3, 5 is plotted against cycle quarters. More particularly, the curve is shown in units of cycles along the abscissa and units of inches per cycle along the ordinate. This is a convenient way to characterize the string feeder's operation because users are concerned with the amount of string fed during each cycle and the length of string fed during each cycle is independent of the machine's rate of operation e.g. cycles per minute. As an example, a typical string feed length for each cycle might be about 7.75 inches. The parameters of the roll speed curve must therefore be chosen such that the area under the curve equals 7.75 inches. Each cycle of the roll speed curve equals one revolution of the non-circular gears. Therefore, in a system where 7.75 inches of string are fed in each cycle, rolls 3 and 5 must be 2.467 inches in diameter, making their circumference 7.75 inches (e.g., $\pi d$)

The higher speed of the rollers 3, 5 is designated $L_2$ in FIG. 8 and the lower speed of the rollers is designated $L_1$.

For example, in the illustrated embodiment the slow speed $L_1$ is 4 inches per cycle and the fast speed $L_2$ is 11.5 inches per cycle. These example speeds are applicable to the first version of the invention as well. The sloping portions of the curve $b_5$ and $b_4$ represent, respectively, the acceleration and deceleration portions of the speed curve for the rollers 3, 5. It is understood that the acceleration and deceleration portions of the speed curve are not actually linear, but the area under the curve is substantially equal to that bounded by the straight lines shown in FIG. 8.

The area under this curve is then defined as:

$$\text{Area}=L_1+0.5(b_1+b_2)(L_2-L_1) \quad \text{(Eqn. 1)}$$

Where;

$b_1$=Total time (repeats) during the trapezoidal portion of the output function curve; and $b_2$=Total dwell time (repeats) at the high speed $L_2$.

If the slow and fast speed dwell times, $b_3$ and $b_2$, respectively, and the acceleration and deceleration dwell times b5 and b4, respectively, are chosen to be all equal as shown in FIG. 8, that is all quarter-cycle repeats, the area under the roll speed curve becomes simply the average of $L_2$ and $L_1$, which in the illustrated embodiment is 7.75 inches.

In greater detail with reference back to FIG. 6, the non-circular gear 69, which is the input gear of the set of gears 69, 71 is keyed on shaft 1075. The Motor-speed reducer output shaft 73 of the motor 67 (which may be the motor of a conventional motor-speed reducer unit) is connected to shaft 1075 through coupling 1031. Input non-circular gear 69 meshes with the output non-circular gear 71 which is keyed on shaft 75 of the coupling 31. The output of the coupling comprises the input shaft 33 of the gearbox 27. Here it is to be emphasized that the FIGS. 6 and 7 version is identical to the FIG. 1 version from the gearbox on and is so shown in FIG. 6 but not further described herein.

To provide the variable roll speeds required by the rollers 3, 5, the radius of the non-circular drive or input gear 69 varies. Moreover, since the center-to-center distance between the non-circular gears 69, 71 remains constant, the radius of the non-circular driven or output gear 71 varies to correspond to the changes in radius of the non-circular input or drive gear 69 so that the two gears remain engaged or enmeshed during rotation. The respective designs of the input and output gears 69, 71 are chosen to obtain the desired output function, for example, the desired speed curve for the rollers 3, 5 such as the speed curve shown in FIG. 8 and discussed above.

To design the non-circular gears 69, 71, first the output function, including the required roll speeds and dwells is laid out, e.g., such as illustrated in FIG. 8, to determine the proper radius of the orbital path taken by the rollers. The radius,R, of the orbital path is determined by first calculating the total area under the output function curve as described previously. The radius is then:

$$R=\text{Area}/2\pi \quad \text{(Eqn. 2)}$$

where;

R=the radius of the orbital path

Area=Area under the output function curve

For the following equations:

$L_1$=The low speed of the rollers driven by the output gear 71

$L_2$=The high speed of the rollers driven by the output gear 69

$b_1$=Total time (repeats) during the trapezoidal portion of the speed curve $b_2$=Total dwell time (repeats) at the high speed $L_2$; and $b_3$=Total dwell time (repeats) at the low speed $L_1$.

With reference to FIG. 7, once the radius R of the orbital path is determined, the ratios and gear angles for the non-circular input and output gears 69, 71 are determined as follows:

$$\theta_{SLOW} \text{ for the input gear}=2\pi b_3 \quad \text{(Eqn. 3)}$$

$$\theta_{FAST} \text{ for the input gear}=2\pi b2 \quad \text{(Eqn. 4)}$$

$$\theta_{ACCELERATE} \text{ for the input gear}=2\pi(b_5-b_2) \quad \text{(Eqn. 5)}$$

$$\theta_{DECELERATE} \text{ for the input gear}=2\pi-(\theta_{SLOW}+\theta_{FAST}+\theta_{ACCELERATE}) \quad \text{(Eqn. 6)}$$

$$\theta_{SLOW} \text{ for the output gear}=(L_1b_3)/R \quad \text{(Eqn. 7)}$$

$$\theta_{FAST} \text{ for the output gear}=(L_2b_2)/R \quad \text{(Eqn. 8)}$$

$$\theta_{ACCELERATE} \text{ for the output gear}=[2b_5(L_1/2+(L_2-L_1)/4)]/R \quad \text{(Eqn. 9)}$$

$$\theta_{DECELERATE} \text{ for the output gear}=2\pi-(\theta_{SLOW}+\theta_{FAST}+\theta_{ACCELERATE}) \quad \text{(Eqn. 10)}$$

$$\text{Slow speed ratio}=Y_1=(\theta_{SLOW} \text{ for the output gear})/(\theta_{SLOW} \text{ for the input gear})=L_1/2\pi R \quad \text{(Eqn. 11)}$$

$$\text{High speed ratio}=Y_2=(\theta_{FAST} \text{ for the output gear})/(\theta_{FAST} \text{ for the input gear})=L_2/2\pi R \quad \text{(Eqn. 12)}$$

Once the proper gear ratios and gear angles have been determined, the coefficients which define the shape of the non-circular gears can be computed. The segments of the peripheries of the input (drive) and output (driven) gears defined by the gear angles $\theta_{SLOW}$ and $\theta_{FAST}$ in each case will define the arc of a circle to insure that the slow and fast dwell times will be of constant speed. However, the segments of the peripheries of the input and output gears for the transition regions defined by the gear angles $\theta_{ACCELERATE}$ and $\theta_{DECELERATE}$ must define non-circular arcs. Noncircular gears designed using a sinusoidal function to define the acceleration and deceleration transitions have been found in practice to give good results. The equation defining the shape of the transitional part of the noncircular gears is:

$$\eta_{ACCELERATION}=A-B\cos C\theta \quad \text{(Eqn. 13)}$$

where $\eta_{ACCELERATION}$ is the gear ratio as a function of angular position during the transition, and $$A=(Y_1+Y_2)/2 \quad \text{(Eqn. 14)}$$

$$B=(Y_2-Y_1)/2 \quad \text{(Eqn. 15)}$$

$$C=2\pi/\theta_{ACCELERATION} \text{ for the input gear} \quad \text{(Eqn. 16)}$$

The actual pitch line radius, ρ, for each noncircular gear can be determined once a choice has been made for the center-to-center distance between the two gears. The gear radii are given by:

$$\rho_{DRIVEN\ GEAR}=D_{CENTER}/(1+\rho_{ACCELERATE}) \quad \text{(Eqn. 17)}$$

$$=D_{CENTER}-\rho_{DRIVEN\ GEAR} \quad \text{(Eqn. 18)}$$

where;

$\rho_{DRIVEN\ GEAR}$=the radius of the noncircular output gear, $\rho_{DRIVE\ GEAR}$=the radius of the non-circular input gear, and $D_{CENTER}$=the desired or chosen center-to-center gear distance.

By computing the gear ratios at intervals along the transition using Equation 13 above, a smooth curve defining the pitch line can be derived using Equations 17 and 18. The resulting smooth curve of the pitch line is used to construct a gear blank which is then used to manufacture the noncircular gears.

The configuration of the non-circular gears for effecting the slow-fast-slow cycle of FIG. 8 is as shown in FIG. 7. U.S. Pat. No. 6,165,306 dated Dec. 26, 2000, entitled Process and Apparatus for Cutting of Discrete Components of a Multi-Component Workpiece and Depositing them with Registration on a Moving Web of Material, which is hereby incorporated by reference, further describes the kinematics involved with non-circular gears. As an example, for the 4 inches per cycle/11.5 inches per cycle operation example discussed previously, the input gear 69 has a maximum dimension of about 2.3894 inches and the output gear 71 has a maximum dimension of about 2.6377 inches. Further, the input gear 69 has a minimum dimension of about 1.3623 inches and the output gear 71 has a minimum dimension of about 1.6106 inches. These dimensions are to be taken as exemplary only and are subject to variation. The motor/speed reducer unit 67 (FIG. 6) may be of a type which can be set for different output speeds. Each revolution of the input gear 69 by the unit 67 effects a slow-fast-slow cycle.

In view of the above, it will be seen that the several objects of the invention are achieved and other advantageous results attained.

As various changes could be made in the above constructions without departing from the scope of the invention, it is intended that all matter contained in the above description and shown in the accompanying drawings shall be interpreted as illustrative and not in a limiting sense.

When introducing elements of the present invention or the preferred embodiments thereof, the articles "a", "an", "the" and "said" are intended to mean that there are one or more of the elements. The terms "comprising", "including" and "having" are intended to be inclusive and mean that there may be additional elements other than the listed elements.

What is claimed is:

1. A method of feeding string forward from a supply, said method comprising:

entraining the string coming from the supply around at least one feed roll, driving said roll continuously in cycles in a direction for feeding the string forward, each of said cycles involving varying speed of the roll for feeding a predetermined length of string forward per cycle, subjecting the string to a force in the reverse direction upstream from said roll, and subjecting the string to a forwarding force downstream from said roll.

2. The method of claim 1 wherein during each cycle the roll is first driven slow, then fast, then slow.

3. The method of claim 2 wherein the roll is driven at a relatively slow speed for the first one-quarter of the cycle, accelerated to a relatively fast speed in the second one-quarter of the cycle, driven at the relatively fast speed for the third one-quarter of the cycle, and decelerated to the relatively slow speed in the last one-quarter of the cycle.

4. A method of feeding string forward from a supply, said method comprising:

entraining the string coming from the supply around a first godet roll and then around a second godet roll in a figure-eight path, driving at least one of the rolls continuously in cycles in a direction for feeding a length of string forward on each cycle, each of said cycles involving varying speed of the roll for feeding a predetermined length of string forward per cycle, blowing air in an upstream flow generally surrounding the string upstream from the first godet roll, blowing air in a downstream flow generally surrounding the string downstream from the second godet roll, the upstream and downstream flows of air subjecting the string to tension as it travels from the upstream flow around the rolls to the downstream flow.

5. The method of claim 4 wherein in each cycle the roll is first driven slow, then fast, then slow.

6. The method of claim 5 wherein the roll is driven at a relatively slow speed for the first one-quarter of the cycle, accelerated to a relatively fast speed in the second one-quarter of the cycle, driven at the relatively fast speed for the third one-quarter of the cycle, and decelerated to the relatively slow speed in the last one-quarter of the cycle.

7. Apparatus for feeding string forward from a supply, said apparatus comprising:

a feed roll, a motor for driving the feed roll in the direction for feeding the string forward, non-circular gears operatively connecting the motor and the feed roll for driving the feed roll in cycles each involving varying speed of the roll for feeding a predetermined length of string forward per cycle, a retarder for subjecting the string to force in the reverse direction upstream from said roll for retarding its forward feed, and an accelerator for subjecting the string to a forwarding force downstream from said roll for exerting a pull on the string to tension the portion of the string between the retarder and the accelerator.

8. Apparatus as set forth in claim 7 wherein the non-circular gears are such as to drive the feed roll in each cycle first slow, then fast, then slow.

9. Apparatus as set forth in claim 8 wherein the non-circular gears are such as to drive the feed roll at a relatively slow speed for the first one-quarter of the cycle, accelerate the roll to a relatively fast speed in the second one-quarter of the cycle, drive the roll at the relatively fast speed for the third one-quarter of the cycle, and decelerate the roll to the relatively slow speed in the last one-quarter of the cycle.

10. Apparatus for feeding string forward from a supply comprising:

first and second godet rolls for entrainment of the string coming from a supply first around the first roll and then around the second in a figure-eight path, a motor for driving at least one of the rolls in the direction for feeding the string forward, non-circular gears operatively connecting the motor and at least one of said first and second rolls for driving said roll in cycles each involving varying speed of the roll for feeding a predetermined length of string forward per cycle, a retarder for subjecting the string to force in the reverse direction for retarding its forward feed, said retarder comprising a venturi having a passage for the string and an inlet for air under pressure to flow through the passage in an upstream direction, an accelerator for subjecting the string to a forwarding force downstream from the second roll for exerting a pull on the string to tension the portion of the string between the retarder and the accelerator, said accelerator comprising a venturi having a passage for the string and an inlet for air under pressure to flow through the latter passage in a downstream direction.

11. Apparatus as set forth in claim 10 wherein the non-circular gears are such as to drive the feed roll in each cycle first slow, then fast, then slow.

12. Apparatus as set forth in claim 11 wherein the non-circular gears are such as to drive the rolls at a relatively slow speed for the first one-quarter of the cycle, accelerate the rolls to a relatively fast speed in the second one-quarter of the cycle, drive the rolls at the relatively fast speed for the third one-quarter of the cycle, and decelerate the rolls to the relatively slow speed in the last one-quarter of the cycle.

13. Apparatus as set forth in claim 12 wherein the non-circular gears comprise an input gear driven by the motor, an output gear meshing with the input gear, and having a gearbox driven by the output gear and driving both rolls in opposite directions for feeding the string forward.

* * * * *

UNITED STATES PATENT AND TRADEMARK OFFICE

CERTIFICATE OF CORRECTION

PATENT NO. : 6,830,172 B2
DATED : December 14, 2004
INVENTOR(S) : Gregory J. Rajala It is certified that error appears in the above-identified patent and that said Letters Patent is hereby corrected as shown below:

Column 2,
Lines 41, 43 and 44, “angle 6” should read -- angle 0 --.

Column 3,
Line 13, “comprises a similar” should read -- comprises a venturi similar --.
Line 15, “String 5” should read -- String S --.
Line 17, “string 5” should read -- string S --.
Line 27, “figure-s path” should read -- figure-8 path --.
Line 34, “TG” should read -- T6 --.
Line 61, “first 14” should read -- first ¼ --
Line 62, “next 14” should read -- next ¼ --.
Line 63, “third 14” should read -- third ¼ --.
Line 64, “last 14” should read -- last ¼ --.

Column 9,
Line 6, “drive the feed roll” should read -- drive the roll --.

Signed and Sealed this

Seventeenth Day of May, 2005

JON W. DUDAS
*Director of the United States Patent and Trademark Office*